United States Patent [19]

Cook

[11] 4,196,704

[45] Apr. 8, 1980

[54] IDLE SPEED CONTROL ACTUATOR

[75] Inventor: John E. Cook, Chatham, Canada

[73] Assignee: Canadian Fram Limited, Chatham, Canada

[21] Appl. No.: 930,623

[22] Filed: Aug. 3, 1978

[51] Int. Cl.[2] ..... F02D 11/08

[52] U.S. Cl. ..... 123/103 R; 123/DIG. 11; 123/103 E

[58] Field of Search ..... 123/97 R, 97 B, 103 R, 123/103 E, 198 DB, DIG. 11; 261/DIG. 18, DIG. 19

[56] References Cited

U.S. PATENT DOCUMENTS

| | | | |
|---|---|---|---|
| 3,287,007 | 11/1966 | Schoeppach | 261/DIG. 18 |
| 3,753,427 | 8/1973 | Cedar | 123/DIG. 11 |
| 3,881,685 | 5/1975 | Hase et al. | 123/97 B |
| 3,996,904 | 12/1976 | Kobuki et al. | 123/103 R |
| 3,999,524 | 12/1976 | Kobayashi et al. | 123/103 R |
| 4,022,179 | 5/1977 | Kalert et al. | 123/97 R |
| 4,059,088 | 11/1977 | Tateno et al. | 123/103 R |
| 4,098,850 | 7/1978 | Tamura | 123/103 E |

*Primary Examiner*—Ronald H. Lazarus
*Assistant Examiner*—Craig R. Feinberg
*Attorney, Agent, or Firm*—Ken C. Decker; William N. Antonis

[57] ABSTRACT

An idle speed control actuator is used to maintain a constant vehicle engine idle speed in response to variations of the load on the vehicle engine. The actuator responds almost immediately to an increase in the load on the engine to prevent the engine from stalling, but reduces idle speed slowly when the load on the engine is reduced during idle conditions or when the throttle control lever is returned to the idle position so that the actuator does not have to "hunt" for the proper engine idle speed. The actuator includes a control plunger which is engaged by the throttle lever when the latter is returned to its engine idle position, so that the position of the throttle lever, and, accordingly, the opening of the carburetor butterfly valve which sets the engine idle speed, is varied in accordance with the position of the plunger. The plunger is positioned by a differential pressure responsive diaphragm, which is responsive to the pressure differential between engine manifold vacuum and ambient atmospheric pressure. Since the engine manifold vacuum varies in accordance with the load on the engine for a given throttle setting, the diaphragm responds accordingly to move the plunger to the proper setting. Since the throttle lever engages the plunger during the engine idle condition, the proper setting of the plunger will also properly position the throttle lever to establish the correct engine idle speed.

5 Claims, 2 Drawing Figures

IDLE SPEED CONTROL ACTUATOR

BACKGROUND OF THE INVENTION

This invention relates to an idle speed control actuator which is adapted to control the idle speed of a vehicle engine.

In order to minimize dangerous vehicle emissions and to maximize fuel economy, it is desirable to set the vehicle engine idle speed at its lowest possible level consistent with smooth engine operation. However, the engine idle speed cannot be set too low, because the load on the engine during idle conditions may vary substantially. For example, if the vehicle engine is being idled and the air conditioning system is turned on, the load on the vehicle engine is substantially increased, and can possibly cause the engine to stall if the butterfly valve opening in the vehicle carburetor is not adjusted accordingly to maintain a constant engine idle speed. Accordingly, it has been proposed to provide a control valve mechanism which cooperates with the vehicle throttle lever (which sets the butterfly valve opening) to vary the idle position of the throttle lever in accordance with the load on the engine, as measured by the vacuum level in the engine intake manifold. While it is necessary that the throttle control mechanism be able to respond almost instantaneously to an increase of engine load in order to prevent the vehicle engine from stalling, it is desirable to reduce the engine speed more slowly when the load is decreased or when the throttle lever is returned to the engine idle position to prevent the control mechanism from having to "hunt" the proper idle speed. Therefore, the present invention proposes an idle control mechanism in which a diaphragm is movably mounted in a housing to divide the latter into a pair of chambers, one chamber of which is connected to ambient atmosphere and the other chamber is connected to engine manifold vacuum. A check valve and orifice are provided in the vacuum line between the housing and the manifold, so that substantially uninhibited communication is permitted from the manifold to the valve, but communication in the other direction is restricted. Further, the valve mechanism includes a plunger, and a plunger spring which yieldably urges the plunger out of the housing towards the position representing maximum engine idle speed. The plunger cooperates with the diaphragm to control communication between the chambers through an orifice in the diaphragm so that, when the spring does urge the plunger towards its maximum extension position, the pressure differential across the diaphragm will be reduced, permitting the diaphragm to follow the plunger.

SUMMARY OF THE INVENTION

Therefore, an important object of my invention is to provide an idle speed control actuator which is capable of responding almost instantaneously to an increase in engine load during engine idle conditions, but which responds to decreases in engine load, or to movement of the throttle lever to the idle position more slowly than the valve response to an increase in engine load, so that the valve does not have to "hunt" for the proper engine idle speed.

Another important object of my invention is to provide an idle speed control mechanism having an integral "dashpot" which dampens movement of the valve mechanism to the proper idle position when the throttle lever is returned to the idle position.

DETAILED DESCRIPTION

Figure 1:
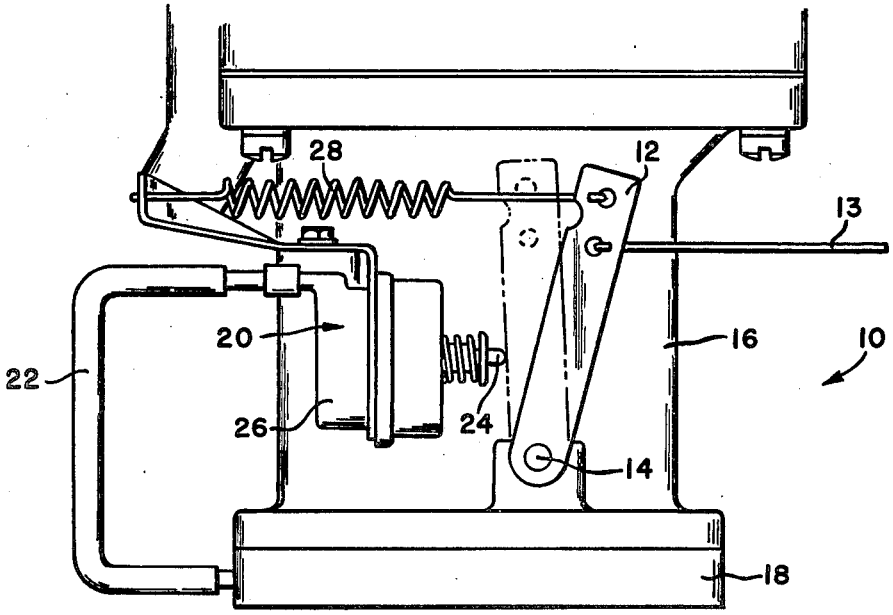
FIG. 1 is a diagrammatic illustration of the vehicle carburetor, the vehicle throttle lever, the throttle return spring, the engine intake manifold, and the idle speed control actuator made pursuant to the teachings of my present invention.

Referring now to the drawings, an engine fuel management system generally indicated by the numeral 10 includes a throttle control lever 12 which is connected to the vehicle accelerator pedal by a linkage 13. The throttle control lever 12 pivots about the pivot point 14, which is connected to the conventional butterfly valve (not shown) within the vehicle carburetor 16. As is well known to those skilled in the art, movement of the lever 12 rotates the butterfly valve to adjust fuel flow through the engine. The carburetor 16 and the aforementioned butterfly valve (not shown) control communication of fuel into the engine induction manifold generally indicated by the numeral 18. As is also well known to those skilled in the art, the manifold 18 is normally at a vacuum when the vehicle engine is being operated. A control actuator generally indicated by the numeral 20, which is made pursuant to the teachings of the present invention, is connected to the manifold vacuum through the vacuum connection line 22. The actuator 20 includes a plunger 24 which extends from the housing 26, and is adapted to control the idle position of the throttle lever 12. A throttle return spring 28, yieldably urges the throttle 12 in the counterclockwise direction illustrated in FIG. 1, to bring the throttle lever 12 into engagement with the plunger 24 (as indicated by the dashed lines on FIG. 1) when the vehicle operator releases the accelerator pedal, thereby removing the force on the linkage 14 tending to pivot the lever 12 in the clockwise direction.

Figure 2:
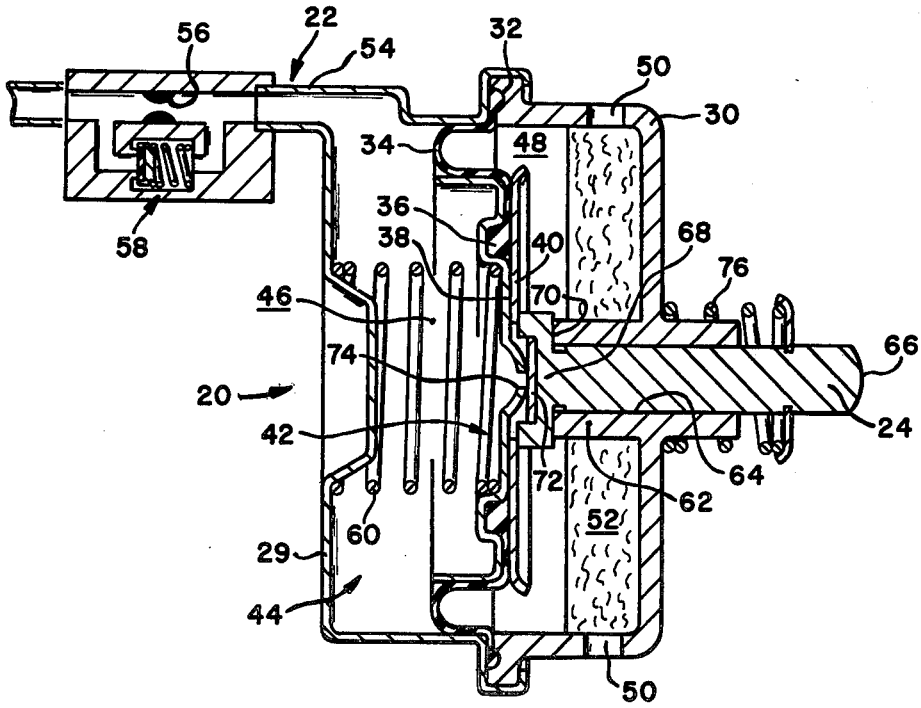
FIG. 2 is a longitudinal cross-sectional view of an idle speed control actuator used in the apparatus illustrated in FIG. 1.

Referring now to FIG. 2 of the drawings, the housing 26 of the actuator 20 comprises sections 29, 30 which cooperate to clamp a circumferentially extending bead 32 which circumscribes the outer perimeter of a flexible annular member 34. Another circumferentially extending bead 36 which circumscribes the inner perimeter of the member 34 is clamped between plates 38 and 40. The plates 38, 40 and the flexible member 34 cooperate to define a diaphragm generally indicated by the numeral 42 which divides the chamber 44 defined within the housing 26 into sections 46, 48. The section 48 of chamber 46 is communicated to ambient atmospheric pressure through openings 50 provided in the wall of the lower section 30 of the housing 26 through a conventional annular filter 52.

The section 46 of chamber 44 is provided with an inlet tube 54 connected to the vacuum line 22, which communicates with the engine manifold vacuum level. An orifice 56 provided in the vacuum line 22 restricts communication from the manifold to the section 46, but a check valve 58 connected in parallel with the orifice 56, permits substantially uninhibited communication in the direction indicated by the arrow, so that an increase in the pressure level in the manifold, representing a vacuum level closer to atmosphere, is communicated immediately into the section 46, but a decrease in the manifold vacuum level (corresponding to a vacuum level further away from atmospheric pressure) is restricted by the orifice 56, so that a time period must elapse before the full effect of the manifold vacuum decrease is communicated into the section 46. A spring 60 is carried in the section 46 and biases the diaphragm of 42 to the right viewing the Figure.

The section 30 of the housing 26 includes a tubular portion 62 which defines a bore 64 therewithin. The bore 64 slidably receives the plunger 24. One end 66 of the plunger 24 projects from the housing 26 and is adapted to engage the throttle lever 12 when the latter is returned to its idle position. The other end 68 of the plunger 24 is stepped to define an abutment surface 70 thereon which cooperates with the end of the tubular portion 62 to define the position of the plunger in which its extension from the housing 26 is maximized. The end 68 of the plunger 24 further carries a sealing pad 72 which cooperates with an orifice 74 in the diaphragm 42 to control communication between the sections 46 and 48 of the chamber 44. Accordingly, when the diaphragm 42 is urged into engagement with the plunger 24, the orifice 74 engages the sealing pad 72 to thereby prevent communication between the sections 46 and 48; however, when the diaphragm is disposed away from the plunger, the sections 46 and 48 communicate with one another through the orifice 74. A spring 76 engages the plunger 24 to urge it downwardly viewing FIG. 1, thereby urging the abutment 70 into engagement with the end of the tube 62. However, the strength of the spring 76 is less than the force exerted on the plunger 24 by the throttle lever 12 when the latter is returned to the idle position, so that the strength of the idle return springs 28 acting on the lever 12 is sufficient to overcome the spring 76 and urge the plunger 24 to the left viewing FIG. 2.

MODE OF OPERATION

Referring to FIG. 2, the various components of the idle speed control actuator 20 illustrated in the positions which they assume when (1) there is no vacuum applied to the vacuum tube, and (2) when the throttle lever is not at its "idle" position, in which the throttle lever contacts the end 66 of the plunger 24. When the throttle lever 12 is moved away from the end 66 of the plunger 24, as occurs, for example, when the vehicle engine is accelerated, the spring 76 urges the plunger 24 to its maximum extension position illustrated in the drawing, with the abutment 70 on the plunger 24 in engagement with the end of the tube 62. When this occurs, of course, the sealing pad 72 moves away from the orifice 74, so that communication is initiated between the sections 46 and 48 of the chamber 44. Accordingly, the pressure differential across the diaphragm 42 is reduced, permitting the spring 60 to urge the diaphragm 42 to the right viewing FIG. 2, so that it "follows" movement of the plunger 24.

When the accelerator pedal is released, the throttle return spring 28 urges the throttle lever 12 toward the position illustrated in the dashed lines in FIG. 1, wherein the throttle lever 12 engages the end 66 of the plunger 24, thereby urging the latter to the left viewing FIG. 2. At the same time, the engine manifold vacuum level will be increased due to the reduced load on the engine, but this increase will not immediately be transmitted to the upper section 46 of chamber 44, because of the orifice 56. Accordingly, as this increase in manifold vacuum is gradually communicated to section 46, the plunger 24 and diaphragm 42 (which is now engaged with the plunger 24 because of the action of the throttle lever 12 urging the plunger upwardly viewing the FIG. 2) will gradually move to the left viewing FIG. 2. When a steady state condition has been reached in which the manifold vacuum level is substantially the same as the vacuum level in the section 46 of chamber 44, the diaphragm 42 will have moved to some predetermined position in the housing which is a function of the manifold vacuum level, the spring 60 having been calibrated at the factory to permit the diaphragm to move into the predetermined position, which is a function of the pressure level across the diaphragm. Therefore, the idle position of the lever 12 is set for the particular load on the vehicle engine. In this condition, the forces on the plunger 24 and diaphragm 42 exerted by the throttle lever 12 due to the effect of the throttle return spring 28 and due to the pressure differential across the diaphragm 42 are balanced by the forces exerted by the spring 60 and the spring 76. However, if the load on the vehicle engine should be increased while the throttle lever 12 remains in engagement with the plunger 24, the engine manifold vacuum level decreases, thereby decreasing the pressure differential across the diaphragm 42. It is noted that a decrease in manifold vacuum will be immediately communicated to the section 46 of chamber 44 because the check valve 58 permits substantially uninhibited fluid communication around the orifice 56. Accordingly, when such a decrease in manifold vacuum occurs because of the increased engine load, the diaphragm 42 will move immediately to the right viewing FIG. 2, to a new position in which the forces acting on the plunger and the diaphragm are again in equilibrium to accommodate the decreased pressure differential across the diaphragm 42. Accordingly, the plunger 24 will be urged outwardly viewing FIG. 2, thereby rotating the throttle lever 12 in the clockwise direction, to increase the carburetor butterfly valve opening to thereby maintain engine idle speed. Obviously, when the load is again decreased, the diaphragm 42, and accordingly the plunger 24, will be moved to the right viewing FIG. 2, but this upward movement will be restricted due to the effect of the orifice 56.

I claim:

1. An idle speed regulator for an internal combustion engine having a manifold, a carburetor, a throttle lever controlling said carburetor, and a throttle return spring yieldably urging said throttle lever to the idle position, said idle speed regulator comprising a housing defining a chamber therewithin, a plunger slidably mounted in said chamber and extending from said housing for engagement with said throttle lever to establish an adjustable idle position to which said throttle return spring urges said throttle, a pressure differential responsive member in said housing dividing the latter into a vacuum chamber communicated to the vacuum level in said manifold and a chamber communicated to ambient atmospheric pressure, resilient means yieldably urging said diaphragm against the end of said plunger and urging said plunger from said housing; valve means for regulating communication between said chambers, and stop means carried by said plunger and by said housing to establish the maximum extended position of said plunger, said resilient means including a first spring urging said plunger toward said stop means and a second spring urging said diaphragm toward said plunger, said first spring being weaker than the throttle return spring whereby said first spring will urge said plunger toward said stop means when the throttle lever is moved away from said plunger but said plunger will be urged away from said stop means when the throttle lever is moved to an idle condition wherein said throttle lever engages the plunger.

2. The invention of claim 1:

and means permitting uninhibited communication from the engine manifold to the vacuum chamber, but providing restricted communication in the reverse direction.

3. The invention of claim 1:

wherein said second spring urges said diaphragm to a predetermined position in said housing for a given pressure differential across said diaphragm and the resultant force of said first spring and the throttle return spring urge the plunger against said diaphragm when the throttle lever engages said plunger.

4. The invention of claim 1:

wherein the valve means for regulating communication between the chambers is carried by the plunger and the diaphragm.

5. The invention of claim 1:

wherein the valve means for regulating communication between the chambers is an orifice in said diaphragm which cooperates with a portion of said plunger to permit communication through the orifice when the diaphragm is moved away from engagement with the plunger and to prevent communication through said orifice when the plunger and diaphragm engage one another.

* * * * *